US005397763A

United States Patent [19]

Fujimura et al.

[11] Patent Number: 5,397,763

[45] Date of Patent: Mar. 14, 1995

[54] METHOD FOR HEAT TRANSFER RECORDING

[75] Inventors: Hideo Fujimura, Kashiwa; Hironobu Hanaki, Shinjuku, both of Japan

[73] Assignee: Dai Nippon Insatsu Kabushiki Kaisha, Japan

[21] Appl. No.: 168,364

[22] Filed: Dec. 17, 1993

Related U.S. Application Data

[63] Continuation of Ser. No. 614,394, Nov. 16, 1990, Pat. No. 5,296,442, which is a continuation of Ser. No. 358,360, May 11, 1989, Pat. No. 5,006,502.

[30] Foreign Application Priority Data

| | | | |
|---|---|---|---|
| Sep. 14, 1987 | [JP] | Japan | 62-228626 |
| Sep. 30, 1987 | [JP] | Japan | 62-246811 |
| Nov. 5, 1987 | [JP] | Japan | 62-280058 |
| Dec. 18, 1987 | [JP] | Japan | 62-321098 |
| Mar. 4, 1988 | [JP] | Japan | 63-51259 |

[51] Int. Cl.[6] ..... B41M 5/035; B41M 5/38

[52] U.S. Cl. ..... 503/227; 156/235; 156/248; 156/249; 428/195; 428/913; 428/914

[58] Field of Search ..... 8/471; 156/235, 248, 156/249; 428/195, 211, 913, 914, 40; 503/227

[56] References Cited

U.S. PATENT DOCUMENTS

| | | | |
|---|---|---|---|
| 4,020,204 | 4/1977 | Taylor et al. | 428/40 |
| 4,660,051 | 4/1987 | Sasaki | 503/227 |
| 4,720,480 | 1/1988 | Ito | 503/227 |
| 5,116,148 | 5/1992 | Ohara et al. | 503/227 |

FOREIGN PATENT DOCUMENTS

| | | | |
|---|---|---|---|
| 57-182488 | 11/1982 | Japan | 503/227 |
| 59-64391 | 4/1984 | Japan | 503/227 |
| 59-95194 | 6/1984 | Japan | 503/227 |
| 59-109393 | 6/1984 | Japan | 503/227 |
| 59-127798 | 7/1984 | Japan | 503/227 |
| 59-198196 | 11/1984 | Japan | 503/227 |
| 60-120096 | 6/1985 | Japan | 503/227 |
| 60-145891 | 9/1985 | Japan | 503/227 |
| 60-222267 | 11/1985 | Japan | 503/227 |
| 60-253593 | 12/1985 | Japan | 503/227 |
| 61-37471 | 2/1986 | Japan | 503/227 |
| 61-44688 | 3/1986 | Japan | 503/227 |
| 61-51391 | 3/1986 | Japan | 503/227 |
| 61-83094 | 4/1986 | Japan | 503/227 |
| 61-84281 | 4/1986 | Japan | 503/227 |
| 61-86289 | 5/1986 | Japan | 503/227 |
| 61-86291 | 5/1986 | Japan | 503/227 |
| 61-139490 | 6/1986 | Japan | 503/227 |
| 61-162388 | 7/1986 | Japan | 503/227 |
| 61-171385 | 8/1986 | Japan | 503/227 |
| 61-185491 | 8/1986 | Japan | 503/227 |
| 61-225090 | 10/1986 | Japan | 503/227 |
| 62-16192 | 1/1987 | Japan | 503/227 |
| 62-66988 | 3/1987 | Japan | 503/227 |
| 62-87387 | 4/1987 | Japan | 503/227 |
| 62-128791 | 6/1987 | Japan | 503/227 |
| 62-128793 | 6/1987 | Japan | 503/227 |
| 62-176896 | 8/1987 | Japan | 503/227 |

*Primary Examiner*—B. Hamilton Hess

*Attorney, Agent, or Firm*—Parkhurst, Wendel & Rossi

[57] ABSTRACT

The heat transfer sheet (10) of the present invention has an image-receiving layer (3) comprising a dye dyeable resin together with a dye layer (2) peelably formed on the surface of a substrate sheet (1), and therefore can form an image of high quality by the heat transfer system without restriction as to the kind of non-transfer material or the surface state.

24 Claims, 5 Drawing Sheets

METHOD FOR HEAT TRANSFER RECORDING

This is a continuation of application Ser. No. 07/614,394, filed Nov. 16, 1990, now U.S. Pat. No. 5,296,442, hich in turn is a Rule 60 continuation of application Ser. No. 07/358,360, filed May 11, 1989, now U.S. Pat. No. 5,006,502.

TECHNICAL FIELD

This invention relates to a heat transfer sheet, and more particularly, is intended to provide a heat transfer sheet which is useful for the heat transfer system in which a sublimable dye (heat migratable dye) is used, and can give a mono-color or multi-color images having excellent image density, sharpness and resolution onto plain paper or pure paper, as a matter of course, and also any kind of image-receiving material.

BACKGROUND ART

As the method for giving excellent mono-color or multi-color images simply and at high speed the ink jet system, the heat transfer system, etc. have been developed instead of the general letter printing method or the printing method of the prior art. Among them, the so-called heat transfer system is the most excellent by use of a heat migratable dye as the method capable of giving a multi-color image comparable to those of color photography and having excellent continuous gradation characteristics.

For the heat transfer sheet to be used in the above heat transfer system, there has been generally employed one obtained by forming a dye layer containing a heat migratable dye on one surface of a substrate film such as polyester film, etc., while on the other hand providing a heat resistant layer on the other surface of the substrate film for prevention of stickiness of the thermal head.

By superposing the dye layer surface of such a heat transfer sheet onto the image-receiving material having an image-receiving layer comprising a polyester resin, etc., and effecting heating imagewise by a thermal head on the back surface of the heat transfer sheet, the dye in the dye layer is migrated onto the image-receiving material to form the desired image.

In the heat transfer system as described above, no satisfactory transferred image can be formed on an image-receiving material having basically no dyeability to dyes, for example, papers such as plain paper, pure paper, etc. moldings comprising thermosetting resins, nondyeable thermoplastic resin films or moldings, metal plates, glass plates, porcelain and earthenware, etc.

Also, when an image is formed with a mass of fine dots, if there is unevenness on the surface of the image-receiving material, "drop-out" (pinhole) will be undesirably generated.

Accordingly, it is generally practiced to prepare an image-receiving sheet for exclusive use with "attachment" of the dye on the surface being improved to give unevenness on the smaller surface, by previously coating the image-receiving substrate such as paper, plastic, etc. However, image-receiving substrates previously prepared cannot be suitable for all uses, and also the preparation of various substrates coated with resins for specific uses involves many demerits in aspects of steps, materials, storage, transport, etc., and there is the drawback that the product cost may be considerably increased.

Particularly, when it is desired to form an image on a part of the substrate, other working may be sometimes applied to the residual portion, whereby coating of a resin on the entire surface is not only superfluous, but even a trouble may be caused to occur.

As an example, when the face picture of a possessor is to be formed on a card for identification, the face may be sufficiently present in the region with a size of about 2 to 3 cm square, and when other working such as printing, signature or others is to be applied at other portions, the resin must be coated only at the determined portions, and since the region to be coated differs depending on the card for identification, it cannot be used interchangeably for different cards for identification.

DISCLOSURE OF THE INVENTION

The present invention has been accomplished in view of the problems of the prior art as described above, and it is intended to provide a heat transfer sheet which enables image formation of excellent quality on any image-receiving material, regardless of the kind of image-receiving material.

In order to accomplish the above object, the heat transfer sheet according to the present invention is a heat transfer sheet comprising a heat migratable dye layer formed on one surface of a substrate sheet, characterized in that an image-receiving layer comprising a resin layer which is transferable (peelable) and dye dyeable is formed on the same side surface.

According to the heat transfer sheet of the present invention as mentioned above, by transfering the resin layer (image-receiving layer) having dyeability onto the image-receiving material surface prior to or simultaneously with heat transfer of the dye and subsequently transfering the dye to the resin layer, it becomes possible to form any desired image easily on any image-receiving material having no dye dyeability, and therefore no paper for exclusive use is required.

BEST MODES FOR PRACTICING THE INVENTION

Referring now to the accompanying drawings by way of examples, the preferred embodiments of the present invention are described in detail.

Figure 1:
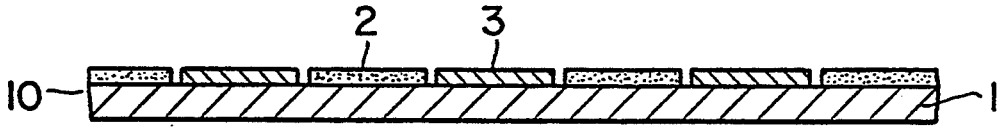
FIG. 1 to FIG. 5, FIG. 7A, FIG. 7B, FIG. 8, FIG. 9, FIG. 11, FIG. 12 and FIG. 15 each represent a sectional view of the heat transfer sheet of the present invention.

FIG. 1 is a sectional view of a preferable example of the heat transfer sheet of the present invention, and the heat transfer sheet 10 of the present invention, in a heat transfer sheet comprising a dye layer 2 formed on a base film 1 as shown in FIG. 1, comprising a resin layer 3 (hereinafter also referred to as image-receiving layer) which is transferable (peelable) and dye dyeable provided on the adjacent layer 2. This example is an example of mono-color heat transfer sheet.

Figure 2A:
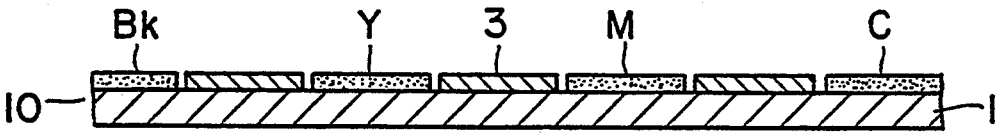
Figure 2B:
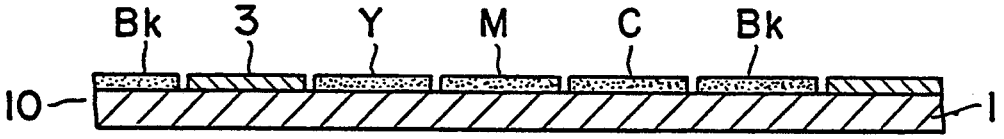

The example in FIG. 1 shows an example of a multi-color heat transfer sheet 10, and in this example, the image-receiving layer 3 may be provided adjacent to every dye layer of each hue (FIG. 2A), or with the three colors of yellow (Y), magenta (M), cyan (C) or the four primary colours of these to which black (BK) is added as one unit, the image-receiving layer 3 may be also formed therebetween (FIG. 2B).

Figure 3:
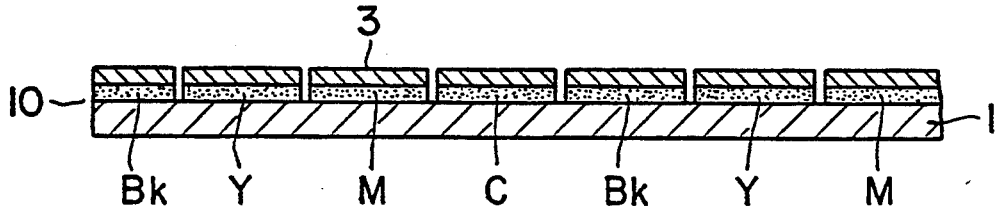

FIG. 3 shows another preferable example, in which case the transferable and dye dyeable image-receiving layer 3 is formed on the surface of the dye layer 2. This example is an example of a multi-color heat transfer sheet, and the same is also the case in mono-color heat transfer sheet as a matter of course as shown in FIG. 1.

Figure 4:
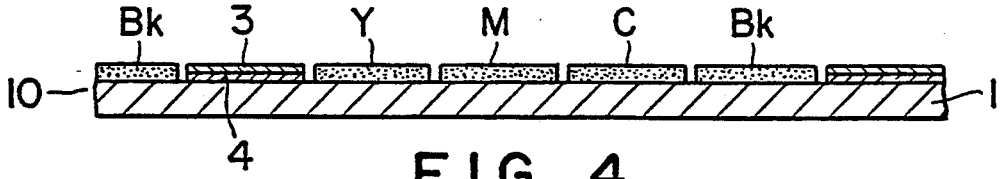

FIG. 4 is a further preferable example, which shows an example in which a peeling layer 4 is interposed between the image-receiving layer 3 and the substrate film 1 in the above example in FIG. 2B. Thus, by interposing a peeling layer 4, peeling of the image-receiving layer 3 and transfer thereof onto an image-receiving material can be facilitated even more. The peeling layer 4 should be preferably peeled off at the interface between the peeling layer 4 and the substrate film 1, and also the peeling layer 4 transferred by peeling together with the image-receiving layer 3 onto the image-receiving material surface. With such a constitution, even when heat transfer may be effected by bringing the dye layer 2 into close contact with the image-receiving layer transferred onto the image receiving material, tackiness between the image-receiving layer 3 and the dye layer 2 after transfer can be prevented, whereby good transfer can be realized. The above example is a modification of FIG. 2B, but it is also similarly applicable in examples of FIG. 1, FIG. 2, FIG. 3 and FIG. 5 as described below as a matter of course.

Figure 5:
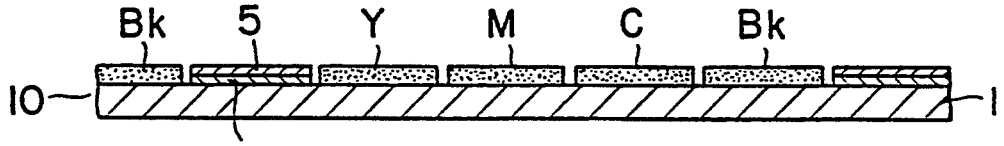

Furthermore, the example shown in FIG. 5 is another preferable example, having the resin layer (image-receiving layer) 3 formed separately as the adhesive layer 5 and the image-receiving layer 6 in the example shown in FIG. 2B. The adhesive layer 5 is positioned at the outermost side and the image-receiving layer at the innerside, whereby it becomes possible to transfer the image-receiving layer 6 to any image-receiving material. Also, in this case, since the image-receiving layer 6 is not required to be softened during transfer, the range of choice of the material for forming the image-receiving layer 6 is considerably enlarged. The above example is a modified example of FIG. 2B, but is similarly applicable also in examples shown in FIG. 1, FIG. 2A, FIG. 3 and FIG. 4 as a matter of course.

Furthermore, to describe by referring to FIG. 2 as an example, if the surface on which the image-receiving layer 3 is to be formed is smooth, the surface of the image-receiving layer 3 transferred onto the image-receiving material becomes smooth, and therefore the image formed there becomes an image with excellent lustre, while on the other hand if the surface on which the image-receiving layer 3 is to be formed is matte, a matte image is obtained for the same reason.

Figure 6A:
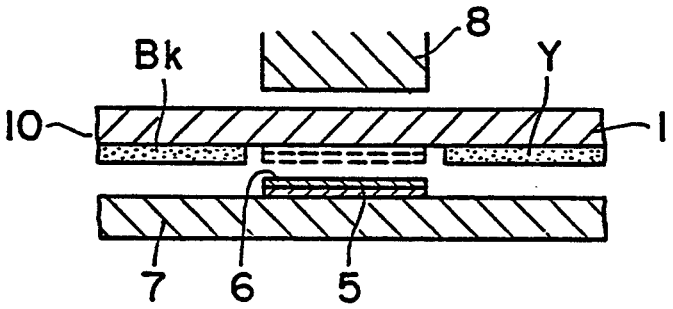
FIG. 6A, FIG. 6B.
Figure 6B:
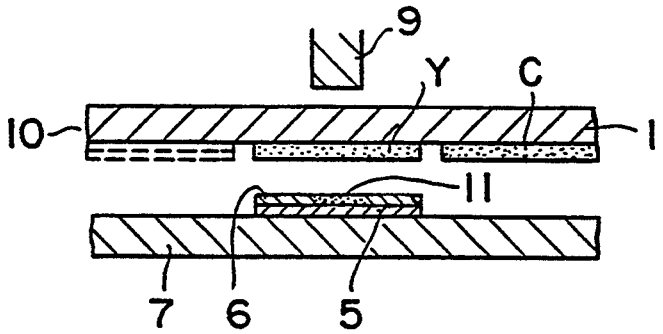

FIG. 6 schematically illustrates the heat transfer method by use of the above heat transfer sheet of the present invention shown in FIG. 5. As shown in the Figure, on the surface of any desired image-receiving material 7 (e.g. plain paper) is superposed the heat transfer sheet 10 of the present invention, and by effecting pressurization- and/or heating on its back surface by means of an appropriate heating means or pressurization means such as heated rolls, hot stamper or thermal head, first the resin layer 4 (adhesive layer 5+image-receiving layer 6) is transferred onto the image-receiving material 7 (FIG. 6A), and then either one of the heat transfer sheets 10 or the image-receiving material 7 is moved to have the dye layer of yellow of the heat transfer sheet 10 superposed at the position of the transferred image-receiving layer 6 to effect heat transfer by the thermal head 9, thereby forming an image 11 of yellow in the image-receiving layer 6. Similarly, by successively matching magenta, cyan and black to effect transfer, a desired multi-color image is obtained. This example is an example in which the heat transfer sheet of the example in FIG. 5 is used, but the same is the case for other examples.

Figure 7A:
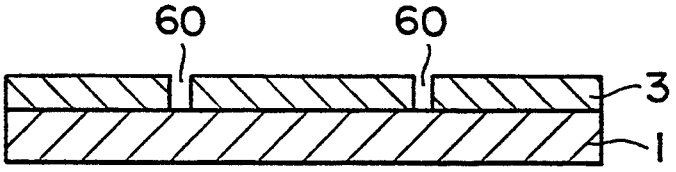

FIG. 7A is a sectional view showing the state having the cutting 60 in which the image-receiving layer portion of the heat transfer sheet is previously cut to a desired shape. Such cut is frequently referred to as "half cut", since it can be seen as a half cut from the whole thickness of the transfer sheet. Thus, if previously half cut, without use of a means capable of varying the section to be heated corresponding to the input signals such as thermal head, there is the advantage that an image-receiving layer of a desired shape can be formed on the image-receiving material.

Figure 7B:
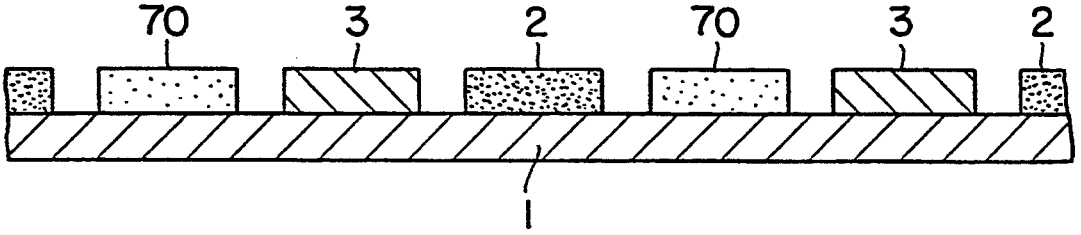

Also, in the present invention, as shown in FIG. 7, a protective layer 70 can be provided peelably on the same surface on which the dye layer 2 and the image-receiving layer 3 are provided. By use of such heat transfer sheet, by superposing a heat transfer sheet having a heat migratable dye at said dye layer surface onto an image-receiving material to transfer the image-receiving layer, and further heating the heat transfer sheet from its back surface with a thermal head, etc., the dye in the dye layer can be migrated to form a desired transfer image on the image-receiving material, followed by transfer of the protective layer provided on the heat transfer sheet. By doing so, a protective image is provided on the image formed, whereby the image portion is coated with said protective layer. According to such method, the transferred image is therefore always under the state having a protective layer thereon without, for example, direct contact at the image portion with a substance which will adsorb the dye, or damage, etc. by external force, and further provided with light resistance. As a consequence, inconveniences such as unfocused images, disintegrated images and the like can be cancelled to give a transfer image provided with excellent storage stability, whereby a good initial image state can be maintained.

Furthermore, in the present invention, a writable layer which is peelable (transferable) can be provided on the substrate sheet. Such a writable layer is a layer on which writing is possible with a pencil, pen, ball pen, etc.

Furthermore, in the heat transfer sheet of the present invention, a detection mark enabling detection of existence, kind, position, etc. of the respective layers as described above by means of an image forming device may be also provided.

In the following, the starting materials, the structure and the preparation method of the heat transfer sheet of the present invention are to be described in more detail.

Substrate sheet

The substrate sheet 1 is a material to be coated for supporting the image-receiving layer during coating of the image-receiving layer, and should desirably have a high mechanical strength such as tensile strength, etc. and heat resistance to the heat ordinarily applied during transfer, and generally a flexible thin sheet such as plastic film, paper, metal foil, etc. may be utilized.

As the substrate sheet 1, most preferably, polyethyleneterephthalate film which is a plastic film may be employed, but films with high heat resistance such as polyphenylenesulfide film, Aramide film, polyimide film, etc. may be also used.

The substrate sheet 1 may have a thickness generally of 2 to 100 μm, preferably about 3 to 50 μm.

Since the smoothness of the surface of the substrate sheet 1 determines the smoothness of the surface of the image-receiving layer after transfer, the substrate sheet 1 is left to remain in the state of the material as such, or alternatively applied with a smoothening treatment such as coating for calendering treatment, corresponding to the extent of smoothness required.

Image-receiving layer

The image-receiving layer 2 is provided by use of a resin with good dyeability of dye and excellent storage stability of the image after formation. As such a resin, there may be employed polyester resin, polyamide resin, meth(acrylic) resin, polyurethane resin, polyvinyl alcohol modified resin (polyvinyl formal, polyvinyl acetal, polyvinyl butyral, etc.), polyvinyl chloride resin, vinyl acetate resin, vinyl chloride/vinyl chloride copolymer resin, styrenic resin, cellulosic resin, etc., and these resins may be used either alone or in mixture.

The resin to be used as the image-receiving layer can be defined in terms of the melt flow index (MFI) from the standpoint of film moldability and transferability, and concerning the present invention, a resin with a melt flow index of 0.5 to 500, preferably 10 to 120 may be employed. For example, if the melt flow index is less than 0.5, the flowability is low, whereby a high temperature is required to effect thermal adhesion by thermal transfer between the substrate to be adhered and the present image-receiving layer, or at lower temperatures, no adhesion may be effected. Furthermore, when thermal transfer is effected under high temperature conditions for effecting strong adhesion, the substrate is required to have heat resistance, whereby inconveniences such as limitation of its material may be caused. On the other hand, with a melt flow index of over 500, the flowability is too high, and the change in form before and after transfer (e.g. enlargement of transferred area, etc.) occurs, therefore involving the problem that attractive heat transfer cannot be effected.

For example, when the substrate sheet 1 is a polyethyleneterephthalate film, as the resin for formation of image-receiving layer, resins such as polymethyl methacrylate, vinyl chloride/vinyl acetate copolymer, cellulose acetate butyrate, polyvinyl butyrate, polyvinyl butyral, polyvinyl acetal, polystyrene, etc. can be used either alone or in mixtures.

The image-receiving layer 3, which is heated under the state superposed on a transfer sheet having a dye transfer layer after transferred onto another substrate, should be desirably imparted with releasability at the interface so that the image-receiving layer and the dye transfer layer may not be thermally fused to each other.

The site at which releasability is given may be the surface of the dye transfer layer of the transfer sheet, or alternatively the surface of the image-receiving layer, or both thereof.

When releasability is given to the image-receiving layer side, a release agent is mixed or dissolved in the image-receiving layer as a whole. Alternatively, the image-receiving layer may be formed by use of a resin having releasability. Or, a layer of a heat release agent may be provided on the substrate sheet side of the image-receiving layer.

"Releasability" as herein mentioned means that the dye transfer layer and the image-receiving layer of the heat transfer sheet are not thermally fused during heating in forming an image by heating with a thermal head, etc. rather than the meaning of ordinary releasability.

As the heat release agent, for example, silicone type compounds such as silicone oils, hardened silicone oils, silicone resins, or silicone modified resins, etc., fluorine type compounds, long chain alkyl type compounds, waxes, or phosphate type surfactants may be employed. These heat release agents can be distributed throughout the image-receiving layer by mixing or dissolving in a coating material for forming the image-receiving layer, followed by coating. Alternatively, a layer of a heat release agent can be provided on the side which becomes the surface of the image-receiving layer after transfer according to such method as using a heat release agent with a large specific gravity, thereby permitting it to be sunk at the position nearer to the substrate sheet during formation of the image-receiving layer, or utilizing the difference between the affinity between the heat release agent and the substrate sheet, and the affinity between the heat release agent and the resin for formation of the image-receiving resin, thereby permitting the heat release agent to be migrated nearer to the substrate sheet. Of course, a layer of the heat release agent may also be provided prior to provision of the image-receiving layer on the substrate sheet.

For providing the image-receiving layer 3 on the substrate sheet 1, the above resin for formation of image-receiving layer, preferably the resin for formation of image-receiving layer and the heat release agent are kneaded together with a solvent or a diluent to provide a composition for the image-receiving layer, which may be then provided on the substrate 1 by a suitable printing method or coating method. If necessary, in the composition for the image-receiving layer, a release agent, antioxidant, UV-ray absorber or fluorescent brightener, etc. may be added in any desired amount.

Separate from the above heat releasability, the releasability during transfer of the image-receiving layer is also important. If the releasability is too light (peeling is very easy), there occurs the phenomenon that the image-receiving layer will be peeled off from the substrate sheet. On the other hand, if the releasability is too heavy (peeling is very difficult), the substrate sheet and the image-receiving layer can be peeled off from each other with difficulty, and sometimes no peel-off may occur either partially or wholly.

The releasability, which depends on the peeling strength between the substrate sheet and the image-receiving layer, is also influenced by the balance with the adhesive force between the image-receiving layer and the image-receiving material.

For ensuring releasability between the substrate sheet and the image-receiving layer, there are (1) the method in which a peeling layer 4 which permits the substrate sheet and the image-receiving layer to be released from each other is provided (this peeling layer is adhered on the substrate sheet side when peeled); and (2) the method in which the image-receiving layer itself is endowed with releasability.

In the method (1), it is necessary to provide a peeling layer on the base film, and releasing is effected between the peeling layer and the image-receiving layer. For providing this peeling layer, it is preferable to employ the method in which the substrate 1 is subjected to melamine treatment, namely coated or kneaded with melamine, isocyanuric acid adduct or melamine, cyanuric acid adduct to obtain a cured coating, or otherwise a material having releasability from the image-receiving layer may be also coated on the substrate sheet or such material may be kneaded into the substrate sheet (for example, the silicone treatment).

In the method (2), there may be releasability generally between the substrate sheet and the image-receiving layer, and it can be realized according to the method in which the image-receiving layer is endowed with heat releasability.

The methods (1) and (2) may be suitably selected, and used either alone or in combination.

By provision of an adhesive layer 5 for imparting adhesion, adhesiveness to the substrate, the transferability to various substrates can be increased. When transfer is effected by heat transfer, the image-receiving layer resin itself can be also endowed with adhesiveness, but it is common practice to form the adhesive layer 5 as a layer separate from the image-receiving layer.

As the base material for the adhesive layer 5, one which can well adhere to the image-receiving material surface is preferable in the sense of enhancing adhesiveness to various substrates, and in this sense, it is preferable to use a thermoplastic resin which is softened during heating and pressurization to exhibit tackiness. Examples of thermoplastic resins may include acrylic type, vinyl type, synthetic rubber type, EVA type, ethylenic type resins.

For providing the adhesive layer 5 on the image-receiving layer 3, the above resin for adhesion may be kneaded together with a solvent or a diluent to form a composition for adhesive layer, which may be then provided on the image-receiving layer 3 by a suitable printing method for coating method. Extrusion coating method may also be employed. If necessary, any additive may be added into the composition for adhesive layer. When pigments, etc. are employed as the additive, a shielding property can be imparted to the image-receiving substrate, or a void filling effect can be imparted.

In the present invention, a cushion layer (not shown) can be further provided on the outer layer side (the side which becomes the lower layer of the image-receiving layer after transfer) of the image-receiving layer 3. Although it is a common practice to further provide an adhesive layer on the outer layer side of the cushion layer, the cushion layer can be also endowed with adhesiveness instead of providing an adhesive layer. The cushion layer may be formed by coating an organic solvent solution of saturated polyester, polyurethane, acrylate, etc. according to reverse roll coating, gravure roll coating, wire bar coating, etc. Also, in place of these organic solvent solutions of synthetic resins, either one or both of aqueous solutions of water soluble synthetic resins or aqueous emulsions of synthetic resins may be employed, but it is particularly preferable to use a resin of high heat resistance. As the above water soluble synthetic resin, there may be included (1) polyacrylamide, (2) various resins containing carboxyl groups such as polyvinyl acetate or carboxyl-modified polyethylene, etc., (3) cellulosic resins, etc. As the synthetic resin emulsion, aqueous emulsions of synthetic resins such as polyacrylate, ethylene/vinyl acetate copolymer, polyurethane, polyester, etc. can be employed. It is also possible to use a mixture of these water soluble synthetic resins and aqueous emulsions. As the method for forming the cushion layer by use of an aqueous synthetic resin or an aqueous emulsion, other than the coating methods as mentioned above, the air knife coating method can be also used. The cushion layer should be preferably formed to a thickness of 3 to 15 μm. By provision of the cushion layer, sharpness of the transferred image like photographic tone can be further improved, and particularly roughness of the image at the highlight portion can be presented.

Furthermore, in the present invention, the image-receiving layer as described above (and the adhesive layer, the peeling layer) can be also colored with a desired color. In the following, this embodiment is to be described.

For example, in the heat transfer sheet of the prior art, although it is desired to effect transfer onto a white ground, if the image-receiving substrate is colored, the whole image is "fogged" when an image is formed by transfer onto such image-receiving substrate, or on the contrary, no image of desired hue can be obtained unless the color of the image-receiving substrate is the desired color. Thus, in the prior art, the image formed by transfer is affected by the color of the image-receiving substrate, and it is not possible to form the image of the same hue on an image-receiving substrate of any desired color. Accordingly, in the present invention, by transferring a transfer layer having at least image-receiving layer and at least one colored layer onto the image-receiving substrate prior to effecting image transfer, the influence of the color of the image-receiving substrate on the image to be formed by transfer can be avoided.

As the colorant to be added in the resin constituting the image-receiving layer, those having no trouble in image formation and storage of image after formation are selected and used from among pigments, dyes. As the pigment, inorganic pigments such as titanium white, titanium yellow, red iron oxide, etc., organic pigments such as phthalocyanine type pigments such as phthalocyanine blue, etc., azo pigments may be employed. Among them, as phthalocyanine type dyes, Heliogen Blue LBG, Heliogen Blue Br, etc. manufactured by BASF, and as the azo type dyes, Helio FAST Yellow FPV, Helio Fast Orange RN, Helio Fast Red BN, Helio Fast Red FG, etc. are available on the market. As the dye, disperse dyes, acidic dyes, metal containing dyes, direct dyes, etc. may be included, and representative disperse dyes available on the market may include Kayaron Polyester Light Yellow 6GSF, Kayaron Polyester Yellow YLF, Kayaron Polyester Red LSF, Kayaron Polyester Red BRSF, Kayaron Polyester Blue RGF, Kayaron Polyester Blue TSF, Kayaron Polyester Gray NG etc. manufactured by Nippon Kayaku K.K. These pigments, dyes may be used by combining a plural number of dyes, combining one or more each of dyes and pigments, etc. Various hues may be included for coloration with colorants, but other than the expression of ordinary hues, fluorescent color can also be expressed and the lustre controlled.

For accurately expressing the hue of the image, it is frequently demanded to enhance the whiteness of the surface of the image-receiving member. For responding to such demand, an extender pigment such as kaolin clay, silica, magnesium carbonate or calcium carbonate, or an inorganic pigment such as barium sulfate, alumina white, titanium oxide or zinc oxide can be added alone or in combination, whereby whiteness can be enhanced simultaneously with improvement of the shielding property. Representative of the above kaolin clay available from the market are JP-100 Kaolin, 5M-Kaolin, NN Kaolin, Hardsil, ST Kaolin, etc. manufactured by Tsuchiya Kaolin K.K.; and representative of titanium oxide are KA-10, KA-15, KA-20, KA-30, KA-35, KA-60, KA-80, KA-90, etc. (all are anatase type titanium oxides), KR-310, KR-380, KR-460, KR-480, etc. (all are rutile type titanium oxides). Also, a small amount of fluorescent brightener or a colored or red dye may be also added to control the whiteness to a desired degree.

The colorant may be added in an amount, which may also depend on its kind, the density of the desired color, preferably of about 5 parts by weight based on 100 parts by weight of the resin constituting the image-receiving layer. The extender pigment and/or the inorganic pigment to be added for enhancing whiteness may be added on the same criterion in an amount of 5 to 20 parts by weight.

Control of peeling strength

As described above, in the heat transfer sheet of the present invention, the peeling strength of the image-receiving layer is important. Particularly, in the present invention, it is critical that the peeling strength of the image-receiving layer is great (namely difficultly peelable) during non-heating, and the peeling strength during heating (namely during transfer) is small (namely readily peelable).

In the present invention, by selecting the composition of the resin constituting the image-receiving layer, an image-receiving layer having the peeling strength under the optimum state as mentioned above can be formed. Particularly, a composition with a melt flow index (M.F.I.) ranging from 0.5 to 500 may be preferably used.

Also, in the present invention, for realizing the peeling strength conditions as mentioned above, a resin with the physical properties and the composition as shown below may be particularly preferably employed as the resin for the image-receiving layer.

(1) Glass transition temperature (Tg): 50°–80° C.

(2) Composition of resin

Vinyl chloride-vinyl acetate copolymer having the following weight ratio:

Vinyl chloride: 60 to 95 parts by weight

Vinyl acetate: 5 to 40 parts by weight (3)

Molecular weight

Weight average molecular weight of 6000 to 55000.

In the present invention, in addition to use of the resin as described above, as already described, the peeling strength can be adequately controlled by provision of a release agent or a release layer. For example, the following methods may be generally included as the method for controlling the peeling strength.

(a) The method of making the peeling strength greater:

The substrate sheet surface is applied with corona treatment or plasma treatment.

(b) The method of making the peeling strength smaller:

In the image-receiving layer, a release agent such as silicone oil, silicone resin, fluorine, resin, etc. is added as the additive.

In the heat transfer sheet of the present invention, as the peeling strength of the image-receiving layer, those within the following ranges are particularly preferred as the values measured by the Instron type tensile strength testing method.

(1) 40 to 100 g/in of peeling strength at temperature of 20° to 40° C.;

(2) 5 to 30 g/in of peeling strength at temperature of 40° to 60° C.

Dye layer

The dye layer 2 to be formed on the substrate sheet 1 as described above is a layer having a dye carried on any desired binder resin.

As the dye to be used, all of the dyes which can be used in the heat transfer sheet of the prior art are effectively available for the present invention, and are not particularly limited. For example, some preferable dyes may include, as red dyes, MS Red G, Macrolex Red Violet R, Ceres Red 7B, Samaron Red HBSL, SK Rubin SEGL, Bimicron SNVP-2670, Resolinred-F3BS, etc.; as yellow dyes, Horon Brilliant Yellow S-6GL, PTY-52, Macrolex Yellow S-6GL, Teradyl Golden Yellow 2RS, etc.; and as blue dyes, Kayaset Blue 714, Waxsoline Blue AP-FW, Horon Brilliant Blue S-R, MS Blue 100, Daito Blue No. 1, etc.

As the binder resin for carrying the dye as described above, all of those known in the art can be used, and preferable examples may include cellulosic resins such as ethyl cellulose, hydroxyethyl cellulose, ethylhydroxy cellulose, hydroxypropyl cellulose, methyl cellulose, cellulose acetate, cellulose acetate butyrate, etc., vinyl resins such as polyvinyl alcohol, polyvinyl acetate, polyvinyl butyral, polyvinyl acetal, polyvinyl pyrrolidone, polyacrylamide, etc., and among them, polyvinyl butyral and polyvinyl acetal are preferred with respect to heat resistance, heat migratability of dye, etc.

The dye layer 2 of the heat transfer sheet 10 of the present invention is formed basically of the above materials, but can also include other various additives known in the art.

Such a dye layer 2 is formed preferably by adding the above dye, binder resin and other optional components in an appropriate solvent to have the respective components dissolved or dispersed therein to prepare a coating material or ink for the formation of the dye layer, and then coating and drying this on the above substrate sheet 1.

The dye layer thus formed has a thickness of 0.2 to 5.0 μm, preferably about 0.4 to 2.0 μm, and the dye in the dye layer should be preferably present in an amount of 5 to 90% by weight, preferably 10 to 70% by weight on the basis of the weight of the dye layer.

The dye layer to be formed may be formed by selecting any desired one color from the above dyes when the desired image is mono-color, or alternatively when the desired image is a multi-color image, for example, suitable cyan, magenta and yellow (further black, if necessary) may be selected to form dye layers of yellow, magenta and cyan (further black, if necessary) as shown in FIG. 2 to FIG. 5. The areas of these dye layers may be made, for example, sizes of A or B corresponding to the desired size of image, namely the size of the image-receiving material.

Protective layer

The protective layer 70 as shown in FIG. 7 in the present invention is transferable by heat transfer, which protects the transferred image from damage, contamination, etc. and may have the property of not disturbing the image during transfer. Examples of the material to be used for formation of the said protective layer 70 may include polyolefin resins such as polypropylene, etc.; halogenated polymers such as polyvinyl chloride, polyvinylidene chloride, etc.; vinyl polymers such as polyvinyl acetate, polyacrylate, etc.; polyester resins such as polyethyleneterephthalate, polybutyleneterephthalate, etc.; polystyrene resins; polyamide resins; copolymer resins of olefins such as ethylene, propylene, etc. with other vinyl monomers; ionomers; cellulosic resins such as ethyl cellulose, cellulose diacetate; polycarbonate; and so on.

As the method for forming the protective layer, it can be formed by dissolving or dispersing the above appropriate resin in a solvent, and applying the solution or dispersion according to the known coating method or printing method. The thickness of the protective layer is not particularly limited, but may be preferably, for example, about 1 to 100 μm.

Figure 8:
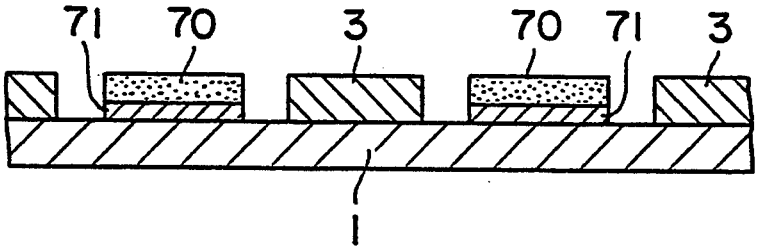

The protective layer may be also formed by providing a peeling layer 71 between the substrate film 1 and the protective layer 70 as shown in FIG. 8, and with such constitution, peeling of the protective from the substrate sheet 1 during transfer becomes better. Said peeling layer 71 may be formed with a resin excellent in peelability known in the art, such as acrylic resin, silicone resin, fluorine resin, etc., according to the method for formation of protective layer as described above, preferably to a thickness of about 0.1 to 50 μm.

Also, in the present invention, an adhesive layer 72 may be also provided by lamination on the protective layer 70, and with such constitution, the protective layer can be surely secured (adhered) onto the counterpart side to effect good transfer. Said adhesive layer 72 may be formed by use of a pressure sensitive or heat sensitive adhesive, etc. according to the same formation method as for the peeling layer 71, preferably to a thickness of, for example, 0.1 to 50 μm. By constituting the adhesive layer 72 of a pressure sensitive adhesive, the protective layer 70 can be transferred only by pressure, while by constituting it with a heat sensitive adhesive, the protective layer 70 can be also transferred by a thermal head, etc.

Figure 9:
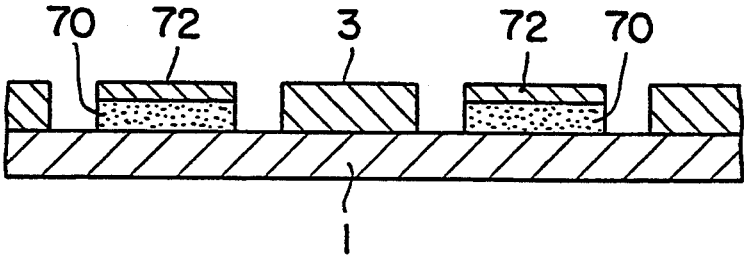

The protective layer 70, the peeling layer 71 and the adhesive layer 72 may be formed respectively as separate layers as shown in FIG. 8 and FIG. 9, or alternatively, although not particularly shown, may be formed as a single layer which functions as both a protective layer and a peeling layer, or as both a protective layer and an adhesive layer, by mixing the respective starting materials.

In the present invention, the protective layer 70 may be transferred wholly (namely, the whole surface of the image-receiving sheet after formation of image) or partially (at least the portion where the image is formed), which is not particularly limited, but when partial transfer is effected, it is preferable to form those layers with a resin having a relatively lower molecular weight or add an inorganic filler into the layers, in order to make the film cutting of the protective layer during transfer.

Figure 10:
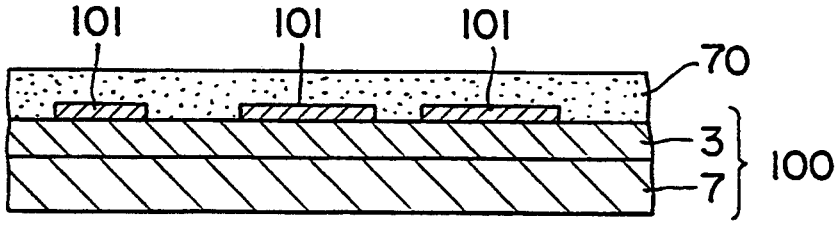
FIG. 10, FIG. 16 and FIG. 17 each represent a sectional view of the state where heat transfer is effected onto a non-transferable material by use of the heat transfer sheet of the present invention.

In carrying out heat transfer by use of the heat transfer sheet of the present invention comprising the above constitution, it may be superposed on an image-receiving sheet (here the sheet having an image-receiving layer), a predetermined dye layer is superposed as opposed to the image-receiving layer, heating is effected from the substrate sheet side of the heat transfer sheet by a predetermined heat energy applying means to form an image from the above dye layer and, in the case of a multi-color image, further subsequent predetermined dye layers are similarly superposed to successively form images under matching with the respective dye layers, to form a desired image by transfer, followed by via the step of transferring the protective layer wholly or partially, whereby an image-receiving sheet 100 completed of heat transfer is obtained, in which a transferred image 101 is formed on the image-receiving layer 3 provided on the sheet substrate 7 as shown in FIG. 10 and a protective layer 70 is formed by transfer on said image 101.

In the heat transfer sheet, an unevenness working can be also applied on the surface of the substrate film 1 at the position where the protective layer is to be formed before formation of the protective layer 3, and when such protective layer is transferred, a protective layer with the upper surface being an uneven surface can be transferred onto the image-receiving sheet side, and also by transferring the protective layers having an uneven surface, the degree of luster, etc. of the image-receiving sheet surface can be controlled. UV-ray absorbers, antioxidants, etc. may also be added in the protective layer:

Writable layer

The writable layer comprises a resin on which writing is possible with a pencil, aqueous pen, ball pen, etc., and for example, it can be formed by use of an ink comprising a formulation of an acrylic acid ester, saturated polyester, vinyl chloride-vinyl acetate copolymer, etc. as the vehicle and an extender pigment such as titanium oxide, zinc oxide, clay, silica fine powder, calcium carbonate, etc. As the means for forming the writable layer, gravure printing, reverse roll coating by use of gravure plate, screen printing, etc. may be employed. The writable layer should preferably have a thickness of about 2 to 10 μm.

Figure 11:
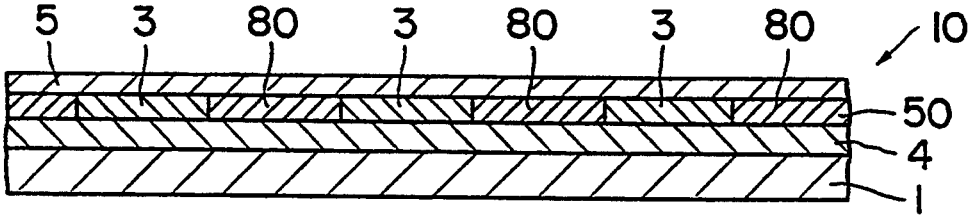
Figure 12:
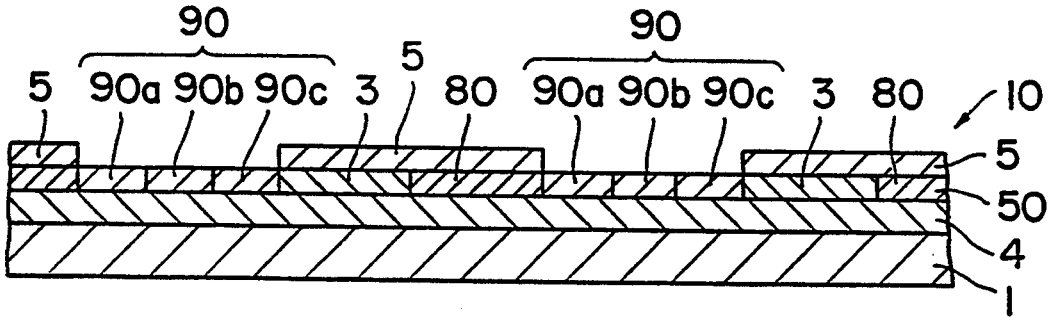

The heat transfer sheet 10 according to the above embodiment of the present invention is not limited to the case where the transfer layer 50 comprises the image-receiving layer 3 and the writable layer 80 provided alternately as shown in FIG. 11, but may also comprise a dye transfer layer 90 comprising the dye layer **90*a* of cyan, the dye layer 90*b* of yellow and the dye layer 90*c* of magenta, an image-receiving layer 3 and a writable layer 80 provided alternately in the transfer layer 50 as shown in FIG. 12, and by use of such transfer sheet, transfer of the image-receiving layer 3, transfer of the writable layer 80 and image transfer onto the transferred image-receiving layer can be effected with one sheet without the use of a separate dye transfer sheet. The image-receiving layer 3, the writable layer 80, the dye transfer layer 90 should be preferably arranged along the flow direction (longer direction) of the heat transfer sheet 10**, but may be also arranged in the width direction.

In the following, the transfer image formation method of the present invention is to be described.

Figure 13:
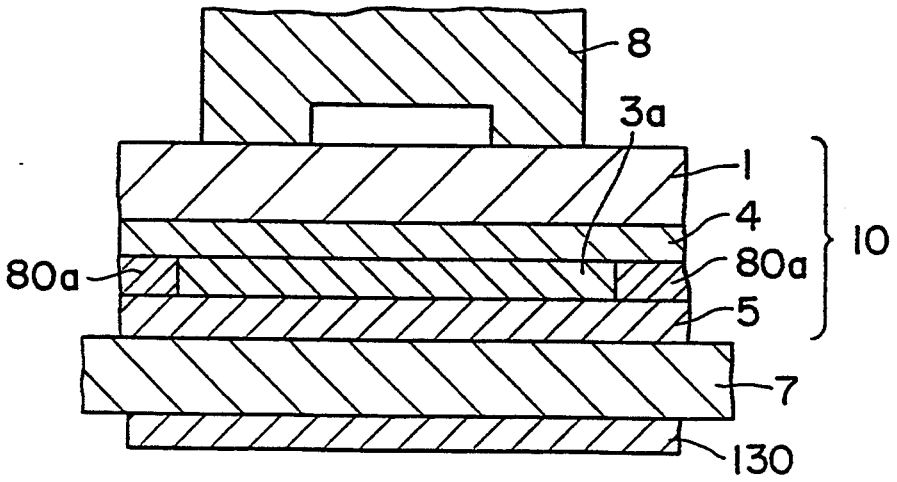
FIG. 13 and FIG. 14 each represent a sectional view showing the manner in which heat transfer is effected by use of the heat transfer sheet of the present invention.
Figure 15:
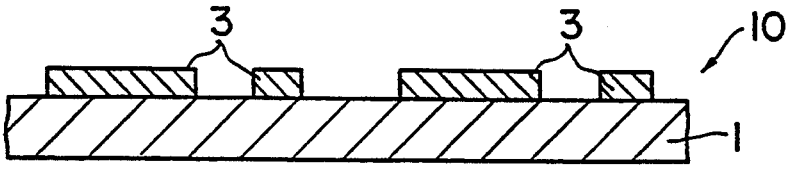

As shown in FIG. 13, first the heat transfer sheet 10 (the example by use of the heat transfer sheet 10 shown in FIG. 11 is shown) and the image-receiving substrate 7 are superposed so that the image-receiving layer of the transfer layer 50 of the heat transfer sheet 10 comes to the position of the image-receiving substrate 7, and heating is effected from the substrate 1 side of the heat transfer sheet 10 by a heating means such as hot stamp 8, etc., simultaneously with pressurization from the image-receiving substrate 7 side by a pressurization means 130, thereby transferring the image-receiving layer **3*a* to a desired pattern, and then the writable layer portion of the heat transfer sheet 10 is superposed on the image-receiving substrate 7 with registration, to similarly transfer the writable layer 80***a* to a desired pattern. As the image-receiving substrate 7 to be used in the above transfer, various materials such as paper, plastic, plate, cloth, nonwoven fabric, metal, glass, stone, wood, porcelain, etc. can be utilized, and, if necessary, void filling treatment, pretreatment for improvement of adhesive force, etc. may be also applied. As the heating means, heating rolls, thermal head, etc. may be used instead of the hot stamp 8. As the pressurization means 130, platen roll, etc. can be used. Also, as the heat transfer sheet, one having the image-receiving layer 3 previously provided to a desired shape on the substrate sheet 1 as shown in FIG. 15 can be used, and by use of such heat transfer sheet, there is the advantage that an image-receiving layer with a desired pattern can be transferred easily without the use of a heating means such as hot stamp 8 having the heating portion formed to a desired shape or a thermal head capable of changing the heating region corresponding to the input signals. When the image-receiving substrate 7 itself has writability, no writable layer 80 is required to be provided, but only an image-receiving layer may be provided partially on the image-receiving substrate 7.

Figure 14:
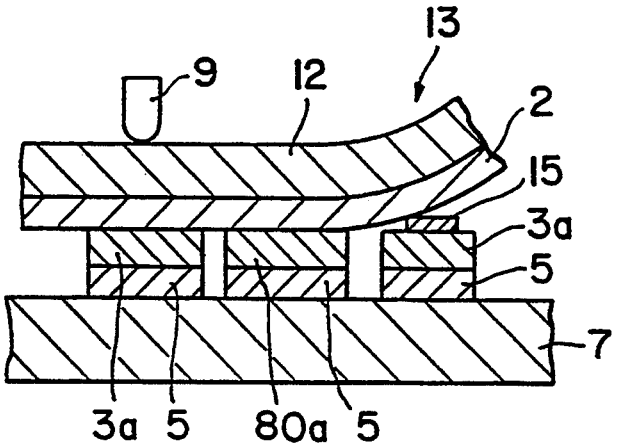

Subsequently, on the surface where the image-receiving layer 3*a* and the writable layer 80*a* are transferred, is superposed the dye transfer layer 2 side of the dye transfer sheet 13 having the dye transfer layer 2 provided on one surface of the substrate 12 as shown in FIG. 14, and after heating is effected by the thermal head 9 from the substrate side of the dye transfer layer 2 in contact with the image-receiving layer 3*a*, the dye transfer sheet 13 is peeled off, whereby a transferred product having the image 15 formed by transfer onto the image-receiving layer 3*a* surface can be obtained. As the dye transfer sheet 13, one formed separately from the heat transfer sheet 10 having the image-receiving layer may be also used.

In practically carrying out the image formation as described above, although depending on the transfer used to be used, it is possible to utilize (1) a device provided with a feeding-discharging means of the image-receiving substrate, a feeding-discharging means of the sheet for image-receiving layer transfer, and an image-receiving layer transfer means-writable layer transfer means-dye transfer means, or (2) a device provided with a feeding-discharging means of the image-receiving substrate, a feeding-discharging means of transfer sheet to be used for plural functions, an image-receiving layer-writable layer transfer means and a transfer means of dye-dye transfer means. In the method (2), a single thermal head can function as both the transfer means of the image-receiving layer, writable layer and the transfer means of dye.

Figure 16:
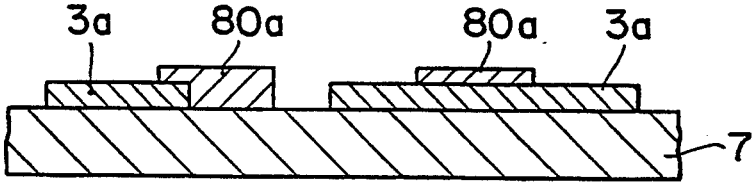
Figure 17:
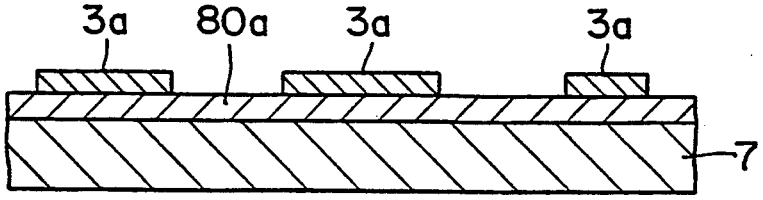

In the above example, description has been made by referring to the case in which the image-receiving layer 3*a* is partially transferred onto the image-receiving substrate 7, and the writable layer 80*a* is formed at the non-formation portion of the transferred image-receiving layer, but, as shown in FIG. 16, the image-receiving layer 3*a* may also be transferred wholly or partially onto the image-receiving substrate 7 (FIG. 16 shows the case of partial transfer), and then the writable layer 80*a* provided so as to be overlapped partially on the image-receiving layer 3*a* transferred, or alternatively it is possible to employ the method in which, as shown in FIG. 17, the writable layer 80*a* may be provided wholly or partially on the image-receiving substrate 7 (FIG. 17 shows the case of provision over the whole surface), and the image-receiving layer 3*a* provided partially on the writable layer 80*a*. The heat transfer sheet is not limited to the embodiment wherein the transfer layer 50 has the image-receiving layer 3 and the writable layer 80, but may also have a transfer layer 50 comprising only the image-receiving layer.

In the present invention, the image-receiving layer (peeling layer, adhesive layer) may be transferred wholly, or partially, which is not particularly limited, but when partially transferred, it is preferable to form those layers of a resin having relatively lower molecular weight or add an inorganic filler, etc. into the layer, for facilitating the film cutting of the image-receiving layer during transfer.

The heat transfer sheet of the present invention as described above can exhibit sufficient performance even as such, but in addition, a tackiness preventive layer, namely a release layer may be also provided on the dye layer, and furthermore, on the back surface of such sheet for heat transfer recording of the present invention, a heat resistant layer may be also provided for preventing adverse influence from the heat of the thermal head.

The image-receiving material for forming an image by use of the heat transfer sheet as described above may be a material capable of adhering the above image-receiving layer 2 (or adhesive layer 5), as exemplified by papers in general, plastic sheet, wood, metal glass, porcelain, earthenware, various resin moldings, etc., and is not particularly limited, and a desired mono-color or multi-color image can be formed on any article.

For the means for imparting the heat energy to be used in carrying out heat transfer by use of the above heat transfer sheet of the present invention, any of the imparting means known in the art may be used. For example, by means of a recording device such as a thermal printer (e.g. Video Printer VY-100, manufactured by Hitachi K.K.), a desired image can be formed by imparting heat energy of about 5 to 100 $mJ/mm^2$ by controlling the recording time.

According to the present invention as described above, transfer is possible either on an image-receiving material having a dye dyeability as a matter of course, or on an image-receiving material having no dye dyeability, and therefore the greatest drawback of the prior art of requiring paper for exclusive use has been solved.

The present invention is described in more detail by referring to the Examples. In the sentences, parts and percentages are based on weight unless otherwise noted.

EXAMPLE A-1

Three kinds of ink compositions for the formation of dye layers with the compositions shown below ere prepared. Each of these was coated on a polyethylene terephthalate continuous film applied on the back surface with heat-resistant treatment having a width of 25.5 cm and a thickness of 6 μm (Lumilar 6C-F53, manufactured by Toray), in the order shown in FIG. 5 to a coated amount on drying each of 1.0 $g/m^2$ at an area of 25.5 cm×18.2 cm in the order of yellow, magenta and cyan, and again yellow, magenta and cyan were coated with an interval of an area of 25.5 cm×18.2 cm, and by repeating this operation, a heat-transfer film shaped in cotinuous film having continuously the respective dye layers of three colors of yellow, magenta and cyan with vacant regions sandwiched therebetween was obtained.

| | |
|---|---|
| Yellow color | |
| C.I. Solvent Yellow 14-1 | 6.00 parts |
| Polyvinyl butyral resin | 4.60 parts |
| Methyl ethyl ketone | 44.80 parts |
| Toluene | 44.80 parts |
| Magenta color | |
| C.I. Disperse Red 50 | 4.42 parts |
| Polyvinyl butyral resin | 4.32 parts |
| Methyl ethyl ketone | 43.34 parts |
| Toluene | 42.92 parts |
| Cyclohexanone | 5.0 parts |
| Cyan color | |
| C.I. Disperse Blue 241 | 5.48 parts |
| Polyvinyl butyral resin | 4.52 parts |
| Methyl ethyl ketone | 43.99 parts |
| Toluene | 40.99 parts |
| Cyclohexanone | 4.50 parts |

Next, on the surface of the vacant region of the above heat transfer sheet, a coating solution having the composition shown below was coated at a ratio of 10 g/m$^2$ on drying, followed by drying at 100° C. for 30 minutes to form a resin layer (image-receiving layer).

| | |
|---|---|
| Polyacrylic resin (BR-90, manufactured by Mitsubishi Rayon) | 10 parts |
| Methyl ethyl ketone | 90 parts |

Furthermore, on the surface of the above resin layer, a 10% methyl ethyl ketone solution of an ethylene-vinyl copolymer type heat-sensitive adhesive (Ad-37P66, manufactured by Toyo Morton) was coated at a ratio of 2 g/m$^2$ on drying and dried to form an adhesive layer to obtain a heat transfer sheet of the present invention as shown in FIG. 5.

The image-receiving layer of the heat transfer sheet of the present invention having the above dye layer of 3 colors, image-receiving layer and adhesive layer was superposed on a pure paper of A4 size, and heat transfer was effected for the whole surface by hot rolls of 100° C., and then on the surface of the image-receiving layer transferred, the yellow dye layer of the heat transfer sheet was superposed in opposition, and heat transfer was effected by a thermal head from the back surface of the heat transfer sheet under the conditions shown below to obtain a yellow image. Next, magenta and cyan images were similarly formed to form a full color image in color correspondence. The full color image was found to be an image of high quality which reproduced the full color of the original sharply and at high density.

The image obtained similarly as described above for comparative purpose without transfer of the image-receiving layer was substantially without transfer, and was very light and vague image without any practical usefulness at all.

| Heat transfer conditions | |
|---|---|
| Dot density | 6 dot/mm |
| Heat-generating member resistance value | 640 |
| Application energy | 2.0 mJ/dot |
| Sheet delivery speed | 5 mm/sec. |

In the above method, when heat transfer of the image-receiving layer was effected by use of a thermal head in place of the hot rolls of 100° C., the same result was obtained.

The image-receiving layer of the heat transfer sheet of the present invention having-the above dye layer of 3 colors, image-receiving layer and adhesive layer was superposed on a pure paper of A4 size, and heat transfer was effected for the whole surface by hot rolls of 100° C., and then on the surface of the image-receiving layer transferred, the yellow dye layer of the heat transfer sheet was superposed to be opposite, and heat transfer was effected by a thermal head from the back surface of the heat transfer sheet under the conditions shown below to obtain a yellow image. Next, magenta and cyan images were similarly formed to form a full color image in color correspondence. The full color image was found to be an image of high quality which reproduced the full color of the original sharply and at high density.

The image obtained similarly as described above for comparative purpose without transfer of the image-receiving layer was substantially without transfer, which was very light and vague image with no practical usefulness at all.

| Heat transfer conditions | |
|---|---|
| Dot density | 6 dot/mm |
| Heat-generating member resistance value | 640 |
| Application energy | 2.0 mJ/dot |
| Sheet delivery speed | 5 mm/sec. |

In the above method, when heat transfer of the image-receiving layer was effected by use of a thermal head in place of the hot rolls of 100° C., the same result was obtained.

EXAMPLE A-2

A heat transfer sheet of the present invention was obtained in the same manner as in Example A-1 except for using the following materials.

| | |
|---|---|
| Substrate film | the same as in Example 1 |
| Resin layer | vinyl chloride-vinyl acetate copolymer (#1000D, manufactured by Denki Kagaku Kogyo) (Tg 65° C., molecular weight 26000) |
| Adhesive layer | Polyester type heat-sensitive adhesive (Vylon 20SS, manufactured by Toyo Boseki) |
| Yellow dye | C.I. Disperse Yellow 77 |
| Magenta dye | C.I. Disperse Red B |
| Cyan dye | C.I. Solvent Blue 112 |

The image-receiving layer of the heat transfer sheet of the present invention having the above dye layers of 3 colors, an image-receiving layer and an adhesive layer was superposed on the aluminum surface of an aluminum vapor deposited paper of A4 size, and the whole surface heat transfer of the image-receiving layer and the adhesive layer was effected by hot rolls of 100° C., and following the same procedure as in Example A-1, a full color image was formed. The full color image was found to be an image of high quality having a metallic luster and which reproduced the full color of the original sharply and at high density.

The image obtained similarly as described above for comparative purpose without transfer of the image-receiving layer was-substantially without transfer, and was a very light and vague image with no practical usefulness at all.

EXAMPLE A-3

By the use of an ink containing a black heat migratable dye in addition to the ink of 3 colors used in Example A-1, the dye layer of 4 colors, the image-receiving layer and the adhesive layer were respectively formed in the same manner as in Example A-1 to obtain the heat transfer sheet of the present invention.

The image-receiving layer of the heat transfer sheet of the present invention having the dye layer of 4 colors, image-receiving layer and adhesive layer as mentioned above, was superposed on the surface on a white decorative paper for melamine decorative plate of A4 size, and an image-receiving layer and an adhesive layer were formed at 100° C., following otherwise the same procedure as Example A-1 to obtain the heat transfer sheet of the present invention. The heat transfer sheet was found to have excellent performances similarly as Example A-1.

EXAMPLE B-1

Formation of heat transfer sheet

On a polyethylene terephthalate film. (manufactured by Toray K.K., thickness 6 μm), by using successively the coating solutions 1 and 2 shown below, each was coated to a coated amount on drying of 1.5 g/m$^2$ by the gravure reverse coating method to prepare a heat transfer sheet.

| | | |
|---|---|---|
| ① | Coating solution for formation of image-receiving layer | |
| | Polymethyl methacrylate resin (BR-85PMMA resin, manufactured by Mitsubishi Rayon K.K.) | 100 parts by weight |
| | Epoxy-modified silicone (KF-393, manufactured by Shinetsu Kagaku Kogyo K.K.) | 3 parts by weight |
| | Amino-modified silicone (X-22-343, manufactured by Shinetsu Kagaku Kogyo K.K.) | 3 parts by weight |
| | Methyl ethyl ketone | 424 parts by weight |
| ② | Coating solution for formation of adhesive layer | |
| | Heat sealing agent (AD-37P295, manufactured by Toyo Morton K.K.) | 100 parts by weight |
| | Pure water | 100 parts by weight |

Transfer of image-receiving layer onto image-receiving substrate

As the image-receiving substrate, a pure paper (basis weight 70 g) was prepared, and with the sheet for transfer of the image-receiving layer obtained above being superposed on its surface with the adhesive layer side in contact thereon, the image-receiving layer was heat transferred by applying heat and pressure with heated rolls from the heat transfer sheet side to prepare an image-receiving sheet.

Preparation of dye transfer sheet

On a polyester film with a thickness of 6 μm having a heat-resistant layer provided on one side, printing was effected by the gravure printing method on the side where no heat-resistant layer was provided with the use of an ink for formation of a dye transfer layer having the composition shown below to form a dye transfer layer with an amount coated on drying of 1.2 g/m$^2$ thus preparing a dye transfer sheet.

| Ink for formation of dye transfer layer | |
|---|---|
| Cyan dye (disperse dye, Kayaset Blue 714, manufactured by Nippon Kayaku K.K.) | 4 parts by weight |
| Polyvinyl butyral resin (Ethlec BX-1, manufactured by Sekisui Kagaku Kogyo K.K.) | 4.3 parts by weight |
| Solvent (toluene/methyl ethyl ketone/isobutanol = 4/4/1) | 90 parts by weight |

Formation of dye image

The dye transfer sheet obtained above and the pure paper having an image-receiving layer provided thereon were superposed so that the dye transfer layer contacted the image-receiving layer, and by use of a heat-sensitive transfer recording device, printing was effected by a thermal head to form an image. As the result, color recording with a good printing quality having surface luster could be performed.

EXAMPLE B-2

The substrate sheet, the image-receiving layer and the adhesive were the same as in Example B-1, but the coated amount of the image-receiving layer was changed to 1.5 g/m$^2$ and the coated amount of the adhesive layer to 1.0 g/m$^2$ to prepare a heat transfer sheet.

The heat transfer sheet was partially transferred by a thermal head onto a white polyethylene terephthalate film (E-20, thickness 188 μm, manufactured by Toray K.K.), and then on the image-receiving layer transferred was effected printing by means of a heat-sensitive transfer recording device to form an image. Then, the printed product was cut into pieces the size of a name card so as to contain the region where the image was formed to provide a card for identification. The card for identification obtained had a good adhesiveness to the substrate at the image portion, had an image quality similar to a photograph, and color recording with luster could be performed.

EXAMPLE B-3

On a polyethylene terephthalate film (thickness 25 μm) applied with melamine treatment were coated the following coating solutions 1 and 2 both according to the gravure reverse coating method to coated amounts on drying of 2.0 g/m$^2$ for 1 and 1.0 g/m$^2$ for 2 to prepare a heat transfer sheet.

| | | |
|---|---|---|
| ① | Coating solution for formation of image-receiving layer | |
| | Polyester resin (Vylon #500, manufactured by Toyobo K.K.) | 100 parts by weight |
| | Phosphate ester type surfactant (Plysurf A-208B, manufactured by Daiichi Kogyo Seiyaku K.K.) | 240 parts by weight |
| | Toluene | 240 parts by weight |
| ② | Coating solution for formation of adhesive layer | |
| | Polyester resin (Vylon #500, manufactured by Toyobo K.K.) | 100 parts by weight |
| | Methyl ethyl ketone | 400 parts by weight |

The heat transfer sheet obtained was partially transferred onto a white polyethylene terephthalate film (E-20, thickness 188 μm, manufactured by Toray K.K.) by means of a hot stamp transfer device to a side of 50 mm×40 mm.

By use of the same dye transfer sheet as used in Example B-1, printing was effected by a thermal head on the image-receiving layer as transferred above by use of a heat-sensitive transfer recording device to form an image. As the result, color recording of good printing quality and having surface luster could, be partially effected on the white polyethylene terephthalate film.

EXAMPLE B-4

After image-receiving layers accompanied with adhesive layers were provided with intervals similarly as in Example B-1, by use of inks for formation of the respective color dye transfer layers of yellow, magenta and cyan having the compositions shown below, dye transfer layers of 3 colors were provided between the image-receiving layers to provide a transfer sheet.

| | |
|---|---|
| Ink for formation of yellow dye transfer layer | |
| Yellow dye (Phoron Brilliant Yellow S-6GL, manufactured by SANDOZ Co.) | 6.00 parts by weight |
| Polyvinyl butyral resin (Ethlec BX-1, manufactured by Sekisui Kagaku Kogyo K.K.) | 4.52 parts by weight |
| Methyl ethyl ketone | 43.99 parts by weight |
| Toluene | 40.99 parts by weight |
| Cyclohexanone | 4.50 parts by weight |
| Ink for formation of magenta dye transfer layer | |
| Magenta dye (1) (MS Red, manufactured by Mitsui Toatsu Kagaku K.K.) | 2.86 parts by weight |
| Magenta dye (2) (Macrolex Red Violet R, manufactured by Bayer Japan K.K.) | 1.56 parts by weight |
| Polyvinyl butyral resin (Ethlec BX-1, manufactured by Sekisui Kagaku Kogyo K.K.) | 4.32 parts by weight |
| Methyl ethyl ketone | 43.34 parts by weight |
| Toluene | 42.92 parts by weight |
| Cyclohexanone | 5.0 parts by weight |
| Ink for formation of cyan dye transfer layer | |
| Cyan dye (1) (Kayaset Blue 714, manufactured by Nippon Kayaku K.K.) | 1.00 parts by weight |
| Cyan dye (2) (Phoron Brilliant Blue S-R, manufactured by SANDOZ Co.) | 4.80 parts by weight |
| Polyvinyl butyral resin (Ethlec BX-1, manufactured by Sekisui Kagaku Kogyo K.K.) | 4.60 parts by weight |
| Methyl ethyl ketone | 44.80 parts by weight |
| Toluene | 44.80 parts by weight |

The heat transfer sheet comprising an integral combination of the transfer image-receiving layer and the transfer dye layer obtained, by means of a heat-sensitive transfer device, was subjected to transfer of the image-receiving layer for the entire back surface of a postcard (means the surface on the opposite side to the side where address is written (front surface)) by use of a thermal head, and then a dye image was formed on the image-receiving layer to prepare a picture postcard.

EXAMPLE C-1

The 3 kinds of ink compositions for the formation of dye layers with the compositions shown below were prepared. These were each coated in the order of yellow, magenta and cyan according to the dye layers shown in FIG. 2 on a polyethylene terephthalate continuous film applied on the back surface with heat-resistant treatment having a width of 25.5 cm and a thickness of 6 μm (Lumilar 6CF53, manufactured by Toray) to a coated amount on drying each of 1.0 g/m$^2$ at an area of 25.5 cm×18.2 cm, and then yellow, magenta and cyan were coated with intervals of an area of 25.5 cm×18.2 cm, and by repeating this operation, a heat transfer sheet shaped in continuous film having continuously the respective dyes of the 3 colors of yellow, magenta and cyan with vacant regions sandwiched therebetween, was formed. In the following, "parts" mean parts by weight.

| | |
|---|---|
| Ink composition for yellow color | |
| C.I. Solvent Yellow 14-1 | 6.00 parts |
| Polyvinyl butyral resin | 4.60 parts |
| Methyl ethyl ketone | 44.80 parts |
| Toluene | 44.80 parts |
| Ink composition for magenta color | |
| C.I. Disperse Red 50 | 4.42 parts |
| Polyvinyl butyral resin | 4.32 parts |
| Methyl ethyl ketone | 43.34 parts |
| Toluene | 42.92 parts |
| Cyclohexanone | 5.0 parts |
| Ink composition for cyan color | |
| C.I. Disperse Blue 241 | 5.48 parts |
| Polyvinyl butyral resin | 4.52 parts |
| Methyl ethyl ketone | 43.99 parts |
| Toluene | 40.99 parts |
| Cyclohexanone | 4.50 parts |

Next, on the surface of the vacant region in the above heat transfer sheet was coated a coating solution comprising the composition shown below to a coated amount on drying of 1.0 g/m$^2$, followed by drying at 100° C. for 30 minutes to form a protective layer.

| | |
|---|---|
| Coating solution for formation of protective layer | |
| Polyacrylic resin (BR-80, manufactured by Mitsubishi Rayon) | 10 parts |
| Methyl ethyl ketone | 90 parts |

Furthermore, on the surface of the above protective layer was coated and dried a 10% methyl ethyl ketone solution of an ethylene-vinyl acetate copolymer type heat-sensitive adhesive (AD-1790-15, manufactured by Toyo Morton) to a coated amount on drying of 2 g/m$^2$ to give the heat transfer sheet of the present invention.

The above dye layers of 3 colors were superposed on a pure paper of A4 size (having the image-receiving layer), the yellow dye layer of the heat transfer sheet was superposed as opposed thereto, and heat transfer was effected by a thermal head from the back surface of the heat transfer sheet under the conditions shown below to obtain a yellow image. Subsequently, in the same manner, images of magenta and cyan were formed to the above yellow image to form a full color image in color correspondence. Then, on the whole surface of the image forming surface, the protective layer of the heat transfer sheet was heat transferred by a thermal head.

| | |
|---|---|
| Heat transfer conditions | |
| Dot density | 6 dot/mm |
| Heat-generating member resistance value | 640 |
| Applied energy | 2.0 mJ/dot |
| Sheet delivery speed | 5 mm/sec. |

The image forming surface having the protective layer thus obtained had luster and was excellent in friction fastness, etc. when compared with the image forming surface having no protective layer.

EXAMPLE C-2

A heat transfer sheet was obtained in the same manner as in Example C-1 except that the protective layer of the heat transfer sheet was subjected to whole surface heat transfer with hot rolls of 100° C. in place of the thermal head in Example C-1, and then a full color image was formed on a pure paper to transfer the protective layer.

The image obtained, was found to have excellent physical properties similarly as Example C-1, and to also be excellent in its storage stability.

EXAMPLE C-3

A heat transfer sheet was obtained in the same manner as in Example C-1 except for forming the protective layer by use of a coating solution comprising the composition shown below and forming the adbesive layer with the use of a polyester type heat-sensitive adhesive (Vylon #300, manufactured by Toyobo).

| Coating solution for formation of protective layer | |
|---|---|
| Ethyl cellulose (N-14, manufactured by Harcules) | 10 parts |
| Methyl ethyl ketone | 90 parts |

By use of the heat transfer sheet obtained, a full color image was formed on a pure paper in the same manner as in Example C-1 and the protective layer was transferred. As a result, the image obtained was found to have excellent storage stability.

In the above embodiment, by use of a heat transfer sheet provided with a transferable protective layer, heat transfer is performed in which the above protective layer is further transferred after formation of the transfer image, and therefore at least the transferred image is constantly protected by the protective layer being provided thereabove, whereby the image state during transfer formation is surely maintained. As the result, there is a remarkable effect not found in the prior art that a transferred image having excellent storage stability can be constantly and easily obtained.

EXAMPLE D-1

Preparation of heat transfer sheet On a polyethylene terephthalate film (manufactured by Toray K.K., thickness of 6 μm), by successively using the coating solutions 1 and 2 shown below, each was coated by the gravure reverse coating method to a coated amount on drying of 1.5 g/m$^2$ to prepare a heat transfer sheet.

| Coating solution 1 (coating solution for formation of image-receiving layer) | |
|---|---|
| Polymethyl methacrylate resin (BR-85, PMMA resin, manufactured by Mitsubishi Rayon K.K.) | 100 parts by weight |
| Anatase type titanium oxide (KA-10, manufactured by Titanium Kogyo K.K.) | 10 parts by weight |
| Epoxy-modified silicone (KF-393, manufactured by Shinetsu Kagaku Kogyo K.K.) | 3 parts by weight |
| Amino-modified silicone (X-22-343, manufactured by Shinetsu Kagaku Kogyo K.K.) | 3 parts by weight |
| Methyl ethyl ketone | 424 parts by weight |

-continued

| Coating solution 2 (coating for formation of adhesive layer) | |
|---|---|
| Ethylene-vinyl acetate copolymer heat sealing agent (AD-37P295, manufactured by Toyo Morton K.K.) | 100 parts by weight |
| Pure water | 100 parts by weight |

Transfer of image-receiving layer onto image-receiving substrate

As the image-receiving substrate, a pure paper (basis weight 80 g/m$^2$) was prepared, and with the above heat transfer sheet being superposed on its surface with the adhesive layer side contacted thereon, the image-receiving layer was heat transferred by applying heat and pressure with heated rolls from the heat transfer sheet side to prepare an image-receiving sheet.

Preparation of dye transfer sheet

On a polyester film with a thickness of 6 μm having a heat-resistant layer provided on one side, printing was effected by the gravure printing method on the side where no heat-resistant layer was provided with the use of an ink for formation of dye transfer layer having the composition shown below, to form a dye transfer layer with an amount coated on drying of 1.2 g/m$^2$ thus preparing a dye transfer sheet.

| Ink for formation of dye transfer layer | |
|---|---|
| Cyan dye (disperse dye, Kayaset Blue 714, manufactured by Nippon Kayaku K.K.) | 4 parts by weight |
| Polyvinyl butyral resin (Ethlec BX-1, manufactured by Sekisui Kagaku Kogyo K.K | 4.3 parts by weight |
| Solvent (toluene/methyl ethyl ketone/isobutanol = 4:4:1) | 90 parts by weight |

Formation of dye image

The dye transfer sheet obtained above and pure paper having an image-receiving layer provided thereon were superposed so that the dye transfer layer was in contact with the image-receiving layer, and by use of a heat-sensitive transfer recording device, printing was effected by a thermal head to form an image. As the result, color recording with good printing quality and having a sharp white ground could be performed.

EXAMPLE D-2

When the same heat transfer sheet as in Example D-1 was transferred with hot rolls onto a synthetic paper (Yupo FPG-150, manufactured by Oji Yuka K.K.), an image-receiving sheet having a sharp white image-receiving layer formed thereon was obtained. On this sheet, an image was formed by heating printing with a thermal head of the same heat-sensitive transfer device by use of the same dye transfer sheet as in Example D-1, and consequently color recording of good printing quality with a sharp white ground could be performed similarly as in Example D-1.

EXAMPLE D-3

By use of the same heat transfer sheet as in Example D-1, the image-receiving layer was transferred with hot rolls on a telephone card printed with a picture pattern. The card was white on the whole surface with a printed picture pattern being vanished. When an image was formed on this card by use of the same dye transfer sheet as used in Example D-1 by the same method as in Example D-1, an image of high quality was obtained without any influence from the original picture pattern.

EXAMPLE D-4

On the same substrate sheet as in Example D-1, the following coating solutions 1 and 2 were successively coated to obtain a heat transfer sheet.

| Coating solution 1 (coating solution for formation of image-receiving layer) | |
|---|---|
| Vinyl chloride-vinyl acetate copolymer (1000A, manufactured by Denki Kagaku Kogyo, K.K.) | 100 parts by weight |
| Epoxy-modified silicone (KF-393, manufactured by Shinetsu Kagaku Kogyo K.K.) | 3 parts by weight |
| Amino-modified silicone (X-22-343, manufactured by Shinetsu Kagaku Kogyo K.K.) | 3 parts by weight |
| Methyl ethyl ketone | 424 parts by weight |
| **Coating solution 2 (coating for formation of adhesive layer)** | |
| Ethylene-vinyl acetate copolymer heat sealing agent (AD-1790-15, manufactured by Toyo Morton K.K.) | 100 parts by weight |
| Dispurse dye (Boron Brill Yellow S-6GL, manufactured by SANDOZ K.K.) | 0.08 parts by weight |
| Pure water | 100 parts by weight |

The heat transfer sheet obtained was partially transferred to a size of 50 mm×40 mm on a white polyethylene terephthalate film (E-20, thickness 188 μm, manufactured by Toray K.K.) by means of a hot stamp transfer device. Subsequently, by use of the same dye transfer sheet as in Example D-1, an image was formed by performing printing on the image-receiving layer having the above image-receiving partially transferred similarly as in Example D-1, an image with warmness was obtained on pale yellow ground.

EXAMPLE D-5

On a polyethylene terephthalate film (thickness 25 μm) applied with melamine treatment, the coating solutions 1, 2 and 3 shown below were successively coated by the gravure reverse coating method to coated amounts on drying of 2.0 g/m$^2$ for the coating solutions 1 and 3 and 1.0 g/m$^2$ for the coating solution 2 to obtain a heat transfer sheet.

| Coating solution 1 (coating solution for formation of image-receiving layer) | |
|---|---|
| Polyester resin (melt flow index M.F.I. 30) | 100 parts by weight |
| Phosphate ester type surfactant (Plysurf A-208B, manufactured by Daiichi Kogyo Seiyaku K.K.) | 20 parts by weight |
| Methyl ethyl ketone | 240 parts by weight |
| Toluene | 240 parts by weight |
| **Coating solution 2 (coating solution for formation of cushioning layer)** | |
| Polyester resin (Vylon #290, manufactured by Toyobo K.K.) | 100 parts by weight |
| Disperse dye (Kayalon Polyester Blue TSF, manufactured by Nippon Kayaku K.K.) | 0.08 parts by weight |
| Methyl ethyl ketone | 240 parts by weight |
| Toluene | 240 parts by weight |
| **Coating solution 3** | |
| Ethylene-vinyl acetate copolymer heat sealing agent (AD-37P295, manufactured by Toyo Morton K.K.) | 100 parts by weight |
| Pure water | 100 parts by weight |

By use of the heat transfer sheet, an image-receiving layer was transferred on a synthetic paper in the same manner as in Example 1, and an image was formed by transfer on the image-receiving layer transferred in the same manner as in Example D-1. As the result, a high quality and attractive image on ground tinted with blue was obtained.

EXAMPLE D-6

After image-receiving layers accompanied with adhesive layers were similarly provided at intervals in the same manner as in Example D-1, by use of the inks for formation of the respective color dye transfer layers of yellow, magenta and cyan having the compositions shown below, dye transfer layers of 3 colors were provided between the image-receiving layers.

| Ink for formation of yellow dye transfer layer | |
|---|---|
| Yellow dye (Phoron Brilliant Yellow, S-6GL, manufactured by SANDOZ Co.) | 6.00 parts by weight |
| Polyvinyl butyral resin (Ethlec BX-1, manufactured by Sekisui Kagaku Kogyo K.K.) | 4.52 parts by weight |
| Methyl ethyl ketone | 43.99 parts by weight |
| Toluene | 40.99 parts by weight |
| Cyclohexanone | 4.50 parts by weight |
| **Ink for formation of magenta dye transfer layer** | |
| Magenta dye (1) (MS Red, manufactured by Mitsui Toatsu Kagaku K.K.) | 2.86 parts by weight |
| Magenta dye (2) (Macrolex Red Violet R, manufactured by Bayer Japan K.K.) | 1.56 parts by weight |
| Polyvinyl butyral resin (Ethlec BX-1, manufactured by Sekisui Kagaku Kogyo K.K.) | 4.32 parts by weight |
| Methyl ethyl ketone | 43.34 parts by weight |
| Toluene | 42.92 parts by weight |
| Cyclohexanone | 5.0 parts by weight |
| **Ink for formation of cyan dye transfer layer** | |
| Cyan dye (1) (Kayaset Blue 714, manufactured by Nippon Kayaku K.K.) | 1.00 parts by weight |
| Cyan dye (2) (Phoron Brilliant Blue S-R, manufactured by SANDOZ Co.) | 4.80 parts by weight |
| Polyvinyl butyral resin (Ethlec BX-1, manufactured by Sekisui Kagaku Kogyo K.K.) | 4.60 parts by weight |
| Methyl ethyl ketone | 44.80 parts by weight |
| Toluene | 44.80 parts by weight |

By use of the heat-sensitive transfer sheet comprising an integral combination of the transfer image-receiving layer and the transfer layer- obtained, first the image-receiving layer was transferred by a thermal head on the back surface (means the surface on the side opposite to the side where address is written (front surface)) of a postcard by use of a heat-sensitive transfer device, and then the dye image was formed by transfer onto the image-receiving layer transferred to prepare a picture postcard. This picture postcard was found to have a ground which whiter than the postcard itself, and the image obtained was sharp and attractive.

The heat transfer sheet of the present invention in the Examples as described above has at least an image-receiving layer, and also has a transfer layer having at least one colored layer provided peelably on a substrate sheet, and according to the sheet of the present invention, an image-receiving layer colored in a desired color can be formed on an image-receiving substrate. Therefore, it has various effects such that an image of constant hue can be formed by transfer without influence from the hue possessed by the image-receiving substrate itself, or that by mere transfer, an image accompanied with fog of desired hue can be formed, and yet that a dye image of any desired hue can be also formed on any desired image-receiving substrate by forming an image-receiving layer of a desired shape at the desired position of the image-receiving substrate.

EXAMPLE E-1

On a polyethylene terephthalate film (thickness 6 μ, manufactured by Toray K.K.) were alternately coated the composition for formation of image-receiving layer and the composition for formation of writable layer to dried weight of 1.5 g/m$^2$ by the gravure reverse coating method to form an image-receiving layer and a writable layer, followed by coating of a composition for formation of an adhesive layer shown below to a dry weight of 1.5 g/m$^2$ to form a heat transfer sheet.

| Composition for formation of image-receiving layer | |
|---|---|
| Polymethyl methacrylate resin (BR-85MMA resin, manufactured by Mitsubishi Rayon K.K.) | 100 parts by weight |
| Epoxy-modified silicone (KF-393, manufactured by Shinetsu Kagaku Kogyo K.K.) | 3 parts by weight |
| Amino-modified silicone (X-22-343, manufactured by Shinetsu Kagaku Kogyo K.K.) | 3 parts by weight |
| Methyl ethyl ketone | 424 parts by weight |
| **Composition for formation of writable layer** | |
| Saturated polyester (Vylon 290, manufactured by Toyobo) | 100 parts by weight |
| Titanium oxide (KA-10, manufactured by Titanium Kogyo K.K.) | 30 parts by weight |
| Toluene/methyl ethyl ketone (mixed at a volume ratio of 1:1) | 500 parts by weight |
| **Composition for formation of adhesive layer** | |
| Ethylene-vinyl acetate resin type heat sealing agent (AD-37P295, manufactured by Toyo Morton K.K.) | 100 parts by weight |
| Pure water | 100 parts by weight |

With the image-receiving layer portion of the above heat transfer sheet being positioned so as to be overlapped on pure paper (basis weight 70 g) and the adhesive layer side of the heat transfer sheet superposed so as to contact the surface of the pure paper, heating was effected by a hot stamp from the heat transfer sheet side to transfer the image-receiving layer to a desired pattern. Subsequently, by superposing the image-receiving layer transfer sheet so that the writable layer portion may be positioned to overlap the pure paper, heating was effected similarly to transfer the writable layer onto the image-receiving layer non-forming portion.

On the other hand, on a polyethylene terephthalate film with a thickness of 6 μ provided with a heat-resistant layer on one surface was formed a dye transfer layer by printing by use of an ink for formation of dye transfer layer having a composition shown below according to the gravure printing method to a coated amount on drying of 1.2 g/m$^2$ to prepare a dye transfer sheet.

| Ink for formation of dye transfer layer | |
|---|---|
| Cyan dye (disperse dye, Kayaset Blue 714, manufactured by Nippon Kayaku K.K.) | 4 parts by weight |
| Polyvinyl butyral resin (Ethlec BX-1, manufactured by Sekisui Kagaku Kogyo K.K.) | 4.3 parts by weight |
| Solvent (toluene/methyl ethyl ketone/isobutanol = 4/4/1) | 90 parts by weight |

By superposing the dye transfer sheet on pure paper having the above image-receiving layer and writable layer transferred thereon so that the dye transfer layer contacted the image-receiving layer, an image was formed by printing by a thermal head of a heat-sensitive transfer recording device, whereby color recording of good printing quality with -surface luster could be performed. Also, in the writable layer forming portion, writing of letters, etc. could be done with pencil, aqueous pen, ball pen.

EXAMPLE E-2

A heat transfer sheet was prepared in the same manner as in Example E-1 except that a dye transfer layer of cyan with the same composition as in the dye transfer sheet in Example E-1 was further provided in addition to the image-receiving layer and the writable layer. By use of the sheet, after the image-receiving layer was transferred to a desired pattern on a white polyethylene terephthalate film (E-20, thickness 188 μ, manufactured by Toray K.K.) by a thermal head of a heat-sensitive transfer recording device, the writable layer was transferred to a desired pattern at the non-forming portion of the image-receiving layer, and then a color image of cyan was formed at the image-receiving layer forming portion. The image obtained had an attractive luster, and had an image quality comparable to a photograph. Also, it was possible to write using pencils, aqueous pens, and ballpens in the writable layer forming portion.

EXAMPLE E-3

After a composition for formation of image-receiving layer shown below was coated on a polyethylene terephthalate film (thickness 25 μ) applied with melamine treatment to a coated amount of 2.0 g/m$^2$ according to the gravure reverse coating method, a composition for formation of adhesive layer shown below was coated thereon to a coated amount on drying of 1.0 g/m$^2$ according to the gravure reverse coating method to form a heat transfer sheet.

| Composition for formation of image-receiving layer | |
|---|---|
| Polyester resin (Vylon #500, manufactured by Toyobo K.K.) | 100 parts by weight |
| Phosphate ester type surfactant (Plysurf A-208B, manufactured by Daiichi Kogyo Seiyaku K.K.) | 20 parts by weight |
| Methyl ethyl ketone | 240 parts by weight |
| Toluene | 240 parts by weight |
| **Composition for formation of adhesive layer** | |
| Polyester resin (Vylon #500, manufactured by Toyobo K.K.) | 100 parts by weight |

-continued

| | |
|---|---|
| Methyl ethyl ketone | 400 parts by weight |

By use of the heat transfer sheet obtained, the image-receiving layer was transferred on the whole surface on a white polyethylene terephthalate film (E-20, thickness 188 μ, manufactured by Toray K.K.) with heated rolls.

Next, on the same polyethylene terephthalate film as used in the above heat transfer sheet, by use of a composition for formation of a writable layer and a composition for formation of an adhesive layer with the compositions shown below, a writable layer and an adhesive layer were successively provided, and the sheet for transfer of the writable layer obtained was superposed on the film having the above image-receiving layer transferred thereon and the writable layer was partially transferred on the image-receiving layer by heating with a hot stamp.

| Composition for formation of writable layer | |
|---|---|
| Saturated polyester (Vylon 290, manufactured by Toyobo K.K.) | 100 parts by weight |
| Titanium oxide (KA-10, manufactured by Titanium Kogyo K.K.) | 30 parts by weight |
| Toluene/methyl ethyl ketone (mixed at a volume ratio of 1:1) | 500 parts by weight |
| **Composition for formation of adhesive layer** | |
| Ethylene-vinyl acetate resin type heat sealing agent (AD-37P295, manufactured by Toyo Morton K.K.) | 100 parts by weight |
| Pure water | 100 parts by weight |

When an image was formed by printing by a thermal head on the image-receiving layer of this sheet by use of the same dye transfer sheet as used in Example E-1, color recording of good printing quality and having surface luster could be performed. Also, in the writable layer forming portion, it was possible to write using pencils, aqueous pens and ballpens.

EXAMPLE E-4

By use of the same sheet for transfer of writable layer as in Example E-3, a writable layer was transferred on one whole surface of a glass plate by heating with hot rolls, and then by use of the same heat transfer sheet as in Example E-3, an image-receiving layer was partially transferred on the writable layer by heating with a hot stamp. Next, by use of a transfer sheet having dye transfer layers of 3 colors formed by use of inks for formation of dye transfer layer of yellow, magenta and cyan with the compositions shown below, the inks of the 3 colors were suitably overprinted on the above image-receiving layer by a thermal head to form an image.

| Ink for formation of yellow dye transfer layer | |
|---|---|
| Yellow dye (Phoron Brilliant Yellow S-6GL, manufactured by SANDOZ Co.) | 6.00 parts by weight |
| Polyvinyl butyral resin (Ethlec BX-1, manufactured by Sekisui Kagaku Kogyo K.K.) | 4.52 parts by weight |
| Methyl ethyl ketone | 43.99 parts by weight |
| Toluene | 40.99 parts by weight |
| Cyclohexanone | 4.50 parts by weight |

-continued

| Ink for formation of magenta dye transfer layer | |
|---|---|
| Magenta dye (MS-Red, manufactured by Mitsui Toatsu Kagaku K.K.) | 2.86 parts by weight |
| Magenta dye (Macrolex Red Violet R, manufactured by Bayer Japan K.K.) | 1.56 parts by weight |
| Polyvinyl butyral resin (Ethlec BX-1, manufactured by Sekisui Kagaku Kogyo K.K.) | 4.32 parts by weight |
| Methyl ethyl ketone | 43.34 parts by weight |
| Toluene | 42.92 parts by weight |
| Cyclohexanone | 5.0 parts by weight |
| **Ink for formation of cyan dye transfer layer** | |
| Cyan dye (Kayaset Blue 714, manufactured by Nippon Kayaku K.K.) | 1.00 parts by weight |
| Cyan dye (Phoron Brilliant Blue S-R, manufactured by SANDOZ Co.) | 4.80 parts by weight |
| Polyvinyl butyral resin (Ethlec BX-1, manufactured by Sekisui Kagaku Kogyo K.K.) | 4.60 parts by weight |
| Methyl ethyl ketone | 44.80 parts by weight |
| Toluene | 44.80 parts by weight |

The transferred image had luster and an attractive image quality comparable to a color photograph. Also, it was possible to write using pencils, aqueous pens and ballpens in the writable layer forming portion.

UTILIZABILITY IN INDUSTRY

The heat transfer sheet of the present invention has an image-receiving layer capable of transferring the heat transfer sheet itself provided thereon, whereby it becomes possible to have image formation of high quality without restriction as to the kind of non-transfer materials, and therefore it can be widely applied as the image forming means according to the heat transfer system.

We claim:

1. A heat transfer sheet comprising:

a substrate sheet;

an image-receiving layer peelably formed on a surface of the substrate sheet, said image-receiving layer comprising a dyeable resin;

an adhesive layer formed on a surface of said image-receiving layer;

a heat migratable dye layer formed on a plane on which said image-receiving layer is formed; and a heat resistant layer formed on a plane other than the plane on which said image-receiving layer and said heat migratable dye layer are formed.

2. The heat transfer sheet according to claim 1, further comprising a cushion layer formed between said image-receiving layer and said adhesive layer.

3. The heat transfer sheet according to claim 1, further comprising a protective layer peelably formed on said plane on which said image-receiving layer is formed.

4. The heat transfer sheet according to claim 3, wherein said protective layer comprises a resin selected from the group consisting of polyester resins, poly(vinyl acetate) resins and acrylic resin.

5. The heat transfer sheet according to claim 3, wherein said protective layer further comprises at least one of an adhesive layer and a release layer.

6. The heat transfer sheet according to claim 3, wherein said protective layer comprises at least one of a UV absorber and an antioxidant.

7. The heat transfer sheet according to claim 3, wherein said protective layer comprises an inorganic filler.

8. The heat transfer sheet according to claim 1, further comprising a writable layer peelably formed on said plane on which said image-receiving layer is formed.

9. The heat transfer sheet according to claim 1, wherein said image-receiving layer is previously cut to a desired shape.

10. The heat transfer sheet according to claim 1, wherein said heat migratable dye layer comprises at least one layer containing a yellow dye, magenta dye, cyan dye or black dye.

11. The heat transfer sheet according to claim 1, wherein said image-receiving layer further comprises a release agent.

12. The heat transfer sheet according to claim 1, wherein said receiving layer further comprises an inorganic pigment.

13. The heat transfer sheet according to claim 1, wherein said image-receiving layer further comprises at least one of an antioxidant, UV-ray absorber and fluorescent brightener.

14. The heat transfer sheet according to claim 1, wherein said adhesive layer comprises a pigment.

15. The heat transfer sheet according to claim 1, further comprising a peeling layer formed between said substrate sheet and said image-receiving layer.

16. The heat transfer sheet according to claim 15, wherein at least one layer is colored with a pigment, dye or fluorescent brightener.

17. The heat transfer sheet according to claim 1, wherein at least one layer is colored with a pigment, dye or fluorescent brightener.

18. The heat transfer sheet according to claim 1, wherein said dyeable resin of said image-receiving layer has a glass transition temperature (Tg) of 50° to 80° C.

19. The heat transfer sheet according to claim 1, wherein said image-receiving layer has a desired shape.

20. The heat transfer sheet according to claim 1, wherein the surface of said substrate sheet on which said image-receiving layer is formed is matte.

21. An article having a sublimation transferred image obtained by use of the heat transfer sheet of claim 1.

22. The article according to claim 21, further comprising a paper or postcard on which the sublimation transferred image is formed.

23. The article according to claim 22, wherein the image is sublimation transferred to one major surface of said postcard and space for writing an address is provided on an opposite major surface of said postcard.

24. An article having an image-receiving layer obtained by use of the heat transfer sheet of claim 1.

* * * * *

UNITED STATES PATENT AND TRADEMARK OFFICE

CERTIFICATE OF CORRECTION

PATENT NO. : 5,397,763

DATED : March 14, 1995

INVENTOR(S) : Hideo FUJIMURA and Hironobu HANAKI

It is certified that error appears in the above-indentified patent and that said Letters Patent is hereby corrected as shown below:

On the title page, item, [30], after the last line insert --Sep. 14, 1988 [WO] WIPO ..... PCT/JP88/00931--.

Signed and Sealed this

Twentieth Day of June, 1995

Bruce Lehman

*Attest:*

BRUCE LEHMAN

*Attesting Officer*

*Commissioner of Patents and Trademarks*